US006477797B1

(12) United States Patent
Takahashi et al.

(10) Patent No.: US 6,477,797 B1
(45) Date of Patent: Nov. 12, 2002

(54) METHOD OF SPREADING LAUNDERED RECTANGULAR CLOTHS AND APPARATUS THEREFOR

(75) Inventors: Nozomu Takahashi, Kagawa-ken (JP); Hiroshi Anzai, Kagawa-ken (JP)

(73) Assignee: Tokai Co., Ltd. (JP)

( * ) Notice: Subject to any disclaimer, the term of this patent is extended or adjusted under 35 U.S.C. 154(b) by 0 days.

(21) Appl. No.: 09/893,778

(22) Filed: Jun. 29, 2001

(30) Foreign Application Priority Data

Oct. 10, 2000 (JP) ..... 2000-308662

(51) Int. Cl.[7] ..... D06F 67/04
(52) U.S. Cl. ..... 38/143
(58) Field of Search ..... 38/143; 198/373, 198/377.03, 379, 465.4; 271/4.01, 8.1; 414/13

(56) References Cited

U.S. PATENT DOCUMENTS 4,313,269 A * 2/1982 Van Rumpt et al. ..... 38/143
4,979,868 A * 12/1990 Ueda et al. ..... 38/143
5,168,645 A * 12/1992 Robin et al. ..... 38/143
5,179,795 A * 1/1993 Nakamura et al. ..... 38/143

FOREIGN PATENT DOCUMENTS

GB 2219313 * 12/1989 ..... 38/143

* cited by examiner

*Primary Examiner*—Ismael Izaguirre
(74) *Attorney, Agent, or Firm*—Lorusso & Loud

(57) ABSTRACT

A method for spreading a laundered rectangular cloth including picking up a portion of the cloth so that the cloth is suspended from the picked portion, and trailing the cloth on a support to position one corner portion, being the trailing end of the cloth, at a predetermined location on the support. After the corner portion has been gripped, the cloth is supported horizontally. The cloth is regripped at two, horizontally spaced apart positions transferred to a conveyor so that a length of one edge of the cloth is straightened and positioned in the downstream end of the conveyor. The straightened edge is grasped and displaced toward a horizontal support bar extending in a direction parallel with the displacing direction to hang the cloth thereon with the opposing short edges being straightened. One of the straightened short edges is fixed to suspend the cloth therefrom in a spread state. A spreading apparatus includes a combination of various gripping, conveying and suspending mechanisms to perform the above method.

9 Claims, 15 Drawing Sheets

METHOD OF SPREADING LAUNDERED RECTANGULAR CLOTHS AND APPARATUS THEREFOR

BACKGROUND OF THE INVENTION

This invention relates to a method of automatically spreading laundered soft rectangular clothes such as face towels and bath towels and an apparatus therefor.

In laundries, relatively small-sized rectangular cloths, such as face towels and bath towels, are washed, dewatered, dried, optionally ironed and then folded. Since the dried cloths discharged from the drying step are crumpled, it is the general practice that operators pick up the dried cloth one by one, spread the picked cloth and then place the spread cloth in position on a conveyor to feed the cloth to a next station such as an ironing machine or a folding machine. Such manual operations are troublesome and require a lot of operators in order to treat a large number of cloths within a limited period of time.

SUMMARY OF THE INVENTION

It is, therefore, an object of the present invention to provide a method of spreading laundered rectangular soft cloths.

Another object of the present invention is to provide a method of the above-mentioned type which can spread a large number of laundered cloths within a short period of time.

It is a further object of the present invention to provide an apparatus for automatically carrying out the above method.

In accomplishing the foregoing objects, there is provided in accordance with one aspect of the present invention a method for spreading a laundered generally rectangular cloth having four corner portions (A–D), opposing longer edges (AB and CD) and opposing shorter edges (BC and DA), comprising the steps of:

(a) picking up a portion (F1) of the cloth and elevating the picked portion so that the cloth is suspended from the picked portion with one corner portion (A) being the lowermost end of the cloth;

(b) trailing the cloth on a support to position the corner portion (A), being the trailing end of the cloth, at a predetermined location on said support;

(c) gripping the corner portion (A) at said predetermined (d) supporting the cloth horizontally at least at the gripped corner portion (A) and a portion (F2) spaced apart from the corner portion (A);

(e) regripping the cloth at two, horizontally spaced apart, first and second positions (G1 and G2) thereof, said first position (G1) being adjacent to the corner portion (A) and said second position (G2) being nearer to the portion (F2) than to said first position (G1) so that the corner portion (D) is suspended therefrom;

(f) displacing the gripped first and second positions (G1 and G2) relative to a conveyor running in one direction from an upstream end to a downstream end while maintaining the line extending through the gripped first and second portions (G1 and G2) generally in normal to the running direction of the conveyor, so that the corner portion (D) and the other portion of the cloth are successively received on the conveyor and moved thereon toward the downstream end with a length of the edge CD eing positioned in the downstream end of the conveyor;

(g) grasping the edge CD of the cloth at two, spaced part, first and second positions (H1 and H2) thereof located within the range of said length;

(h) displacing the grasped first and second positions (H1 and H2) toward a horizontal support bar extending in a direction parallel to the displacing direction of the grasped first and second positions (H1 and H2) to hang the cloth thereon with the short edges (DA and BC) being straightened; and (i) holding one of the straightened short edges (DA and BC) and suspending the cloth from said held edge in a spread state. In another aspect, the present invention provides an apparatus for spreading a laundered rectangular cloth placed in a predetermined position and having four corner portions (A–D), opposing longer edges (AB and CD) and opposing shorter edges (BC and DA), comprising:

an elevating device adapted for picking up a portion (F1) of the cloth placed at the predetermined position and elevating the picked portion at a predetermined height so that the cloth is suspended from the picked portion with one corner portion (A) being the lowermost end of the cloth;

a support having an upper surface adapted to support at least a part of the cloth thereon;

a positioning device for receiving the suspended cloth and trailing the cloth on a support to position the corner portion (A), being the trailing end of the cloth, at a predetermined location on said support;

an end gripper for gripping the corner portion (A) of the cloth positioned in said predetermined height;

supporting means for horizontally supporting the cloth at least at the corner portion (A) and a portion (F2) spaced apart from the corner portion (A);

a pair of grippers for gripping the cloth at two, horizontally spaced apart, first and second positions (G1 and G2) thereof, said first position (G1) being adjacent to the corner portion (A) and said second position (G2) being nearer to the portion (F2) than to the first position (G1) so that the corner portion (D) is suspended therefrom;

a conveyor running in one direction from an upstream end to a downstream end;

a displacing mechanism for displacing said grippers such that the gripped first and second positions (G1 and G2) are displaced relative to said conveyor while maintaining the line extending through the gripped first and second portions (G1 and G2) generally in normal to the running direction of said conveyor, so that the corner portion (D) and the other portion of the cloth are successively received on the conveyor and moved thereon toward the downstream end with a length of the edge CD being positioned in the downstream end of the conveyor;

a horizontal support bar;

a positioning mechanism having a pair of holders for holding the edge CD of the cloth at two, spaced apart, first and second positions (H1 and H2) thereof located within the range of said length and having displacing means for displacing said holders in a direction parallel to said horizontal support bar in position for hanging the cloth thereon with the short edges (DA and BC) being straightened; and a fixing device for holding one of the straightened short edges (DA and BC) and suspending the cloth from the held edge in a spread state.

BRIEF DESCRIPTION OF THE DRAWINGS

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 2:
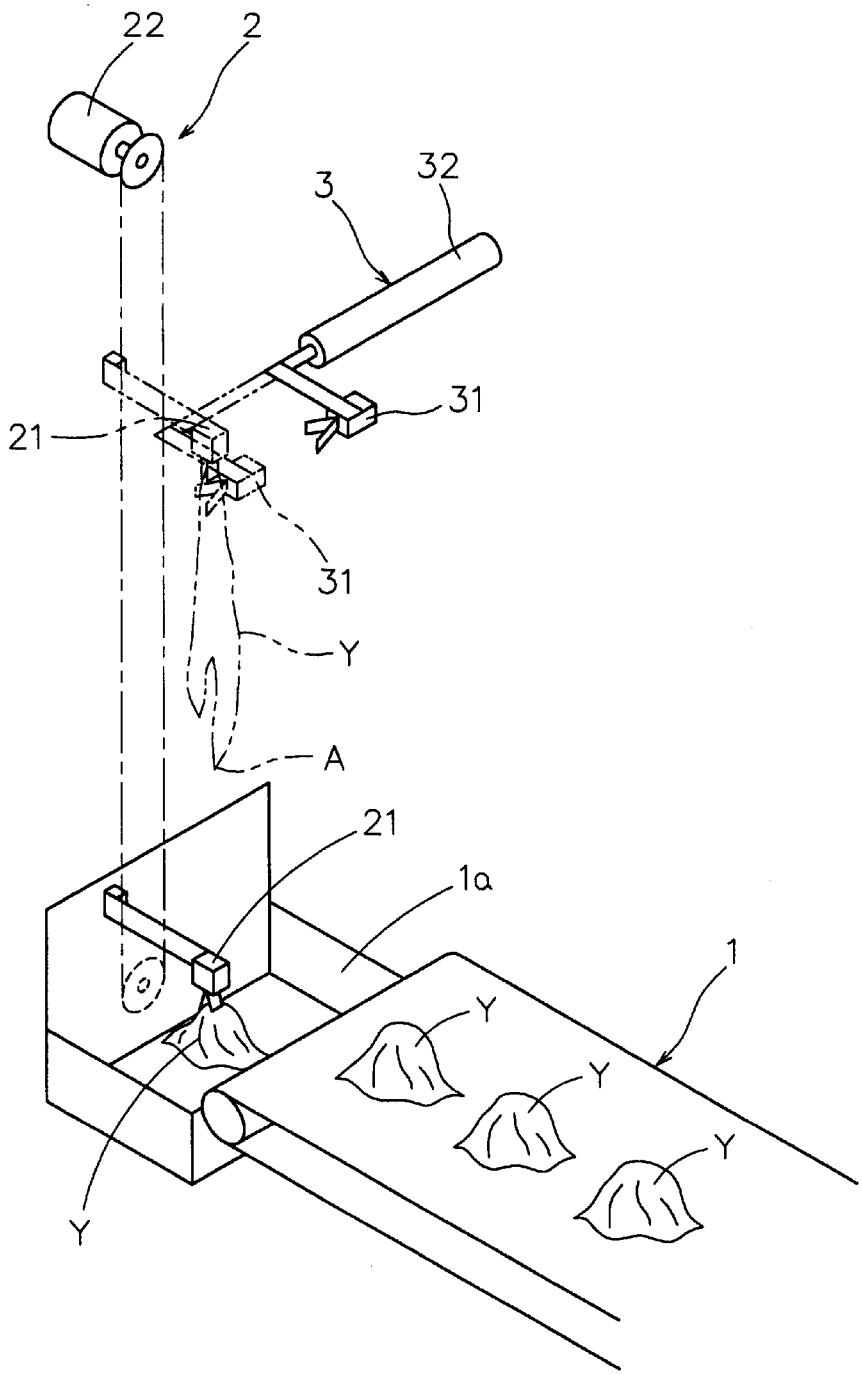
FIG. 2 is a perspective view diagrammaticaly illustrating an elevating device of the apparatus of FIG. 1.

Referring to FIG. 2, the reference numeral 1 denotes a conveyor for receiving rectangular cloths Y, which have been laundered, dewatered and generally dried in the previous step, and for conveying the cloths Y to a bin 1*a* located at the downstream end thereof. Each of the cloths Y is in a crumpled state and should be spread before being subjected to the next treatment such as ironing or folding.

Figure 15:
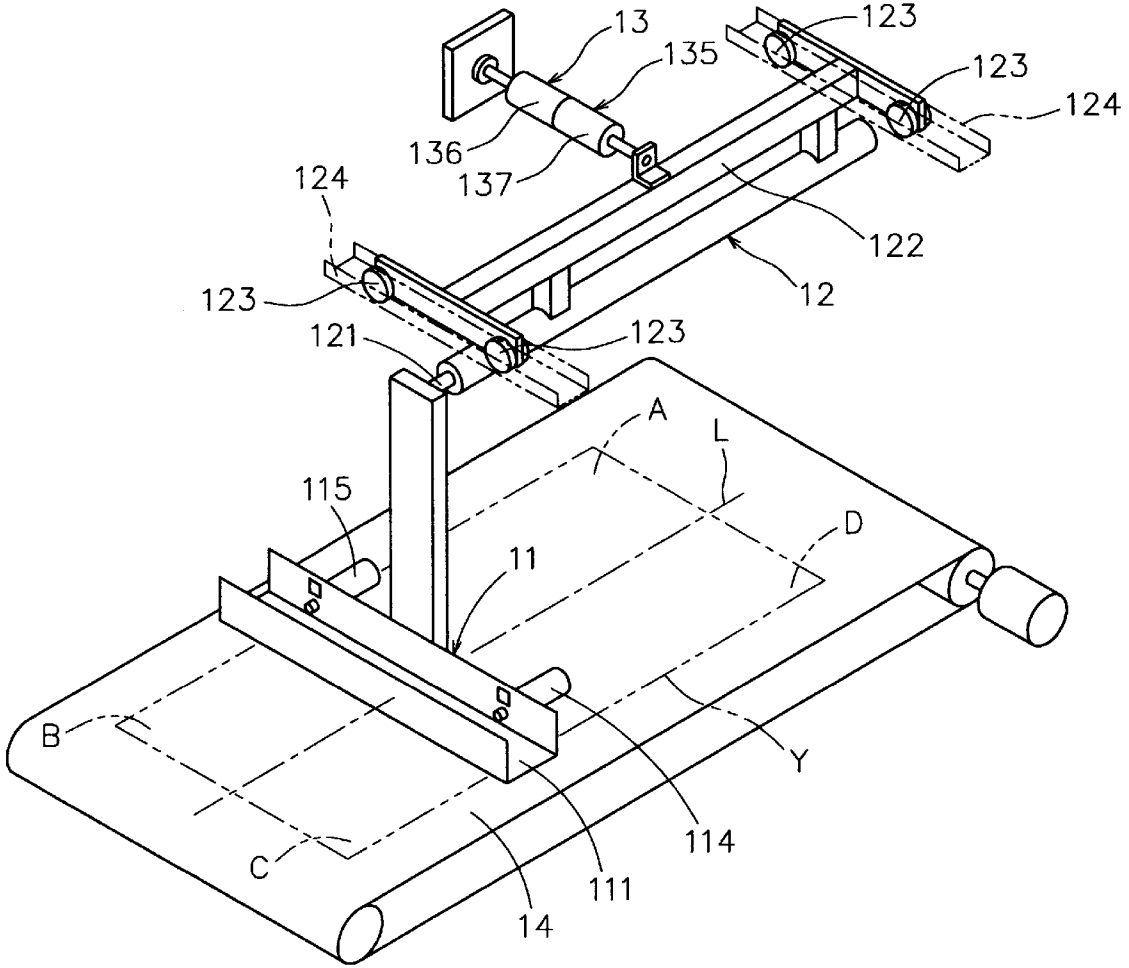

As shown in FIG. 15, the cloth Y has four corner portions A–D, opposing longer edges AB and CD and opposing shorter edges BC and DA. The term "corner portion" herein is intended to refer to a corner or a portion adjacent to the corner.

An elevating device 2 is disposed above the bin 1*a*. The elevating device has a chuck 21 operatively connected to a driving device 22 such as a motor through a suitable mechanism such as a chain and sprocket mechanism, so that the chuck 21 is moveable between an upper position as shown by the two-dotted line and a lower position as shown by the solid line in FIG. 2 by the operation of the driving device 22. In the lower position, the chuck 21 is operable to pick up an arbitrary portion F1 of the cloth Y placed in the bin 1*a*. When the chuck 21 is elevated to the upper position, the cloth Y is suspended from the picked portion F1 with one corner portion A being the lowermost end of the cloth.

Figure 3:
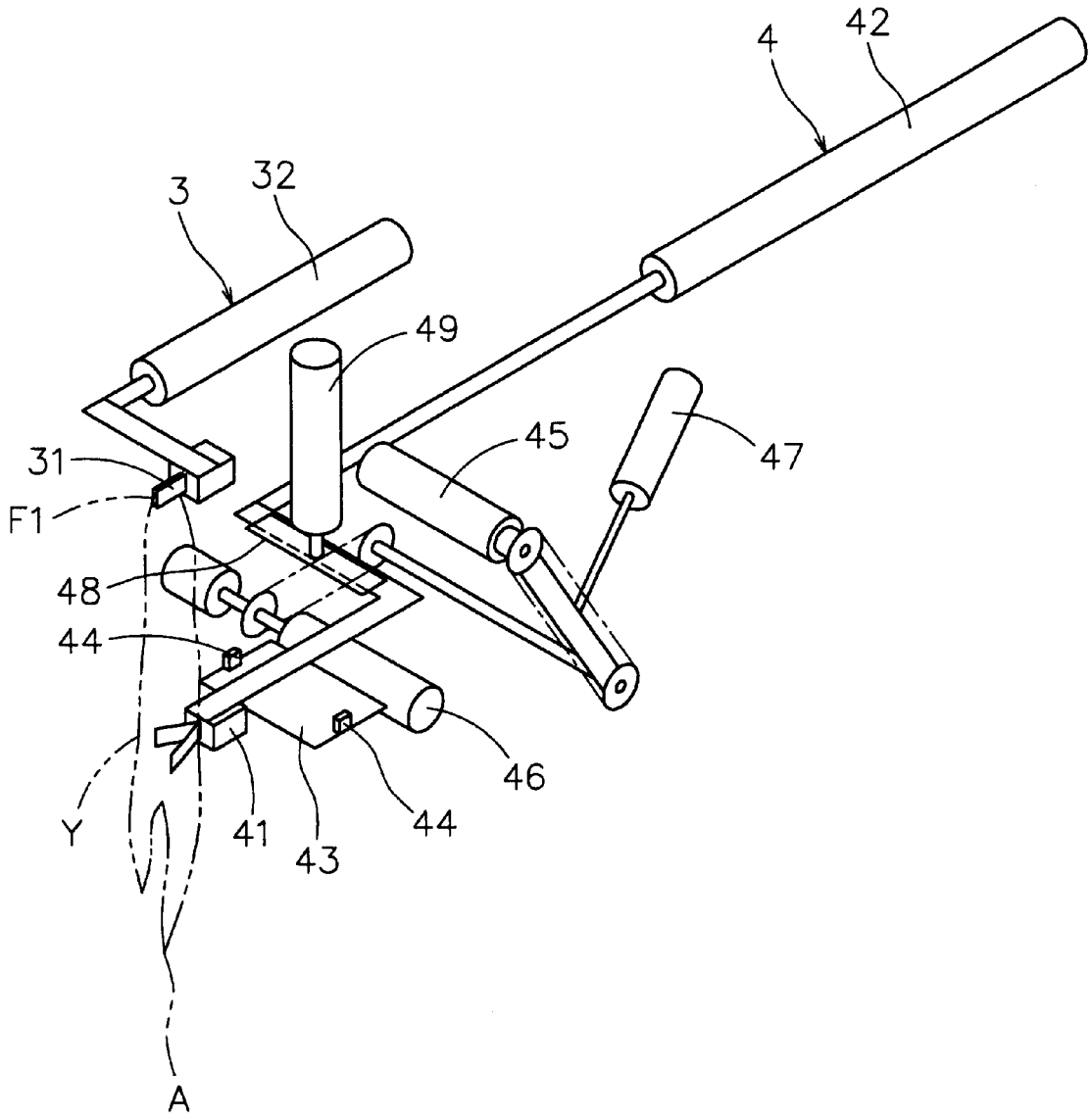
FIG. 3 is a perspective view diagrammaticaly illustrating a positioning device of the apparatus of FIG.

Designated as 3 is a temporarily holding device having a chuck 31 for gripping a portion of the cloth adjacent to the picked portion F1 and a driving mechanism 32 such as an air cylinder for displacing the chuck 31 between an extended position as shown by the two-dotted line and a retracted position as shown by the solid line in FIGS. 2 and 3. When the elevating device 2 has picked up and elevated the cloth Y in the upper position, the chuck 31 extends to the extended position to grip a portion of the cloth adjacent to the picked portion F1. Then the chuck 21 of the elevating device 2 releases the cloth so that the cloth Y is suspended by the chuck 31. The driving mechanism 31 is then actuated to move the chuck 31 to the retracted position. In this case, the corner portion A is still the lowermost end of the cloth Y.

Figure 4:
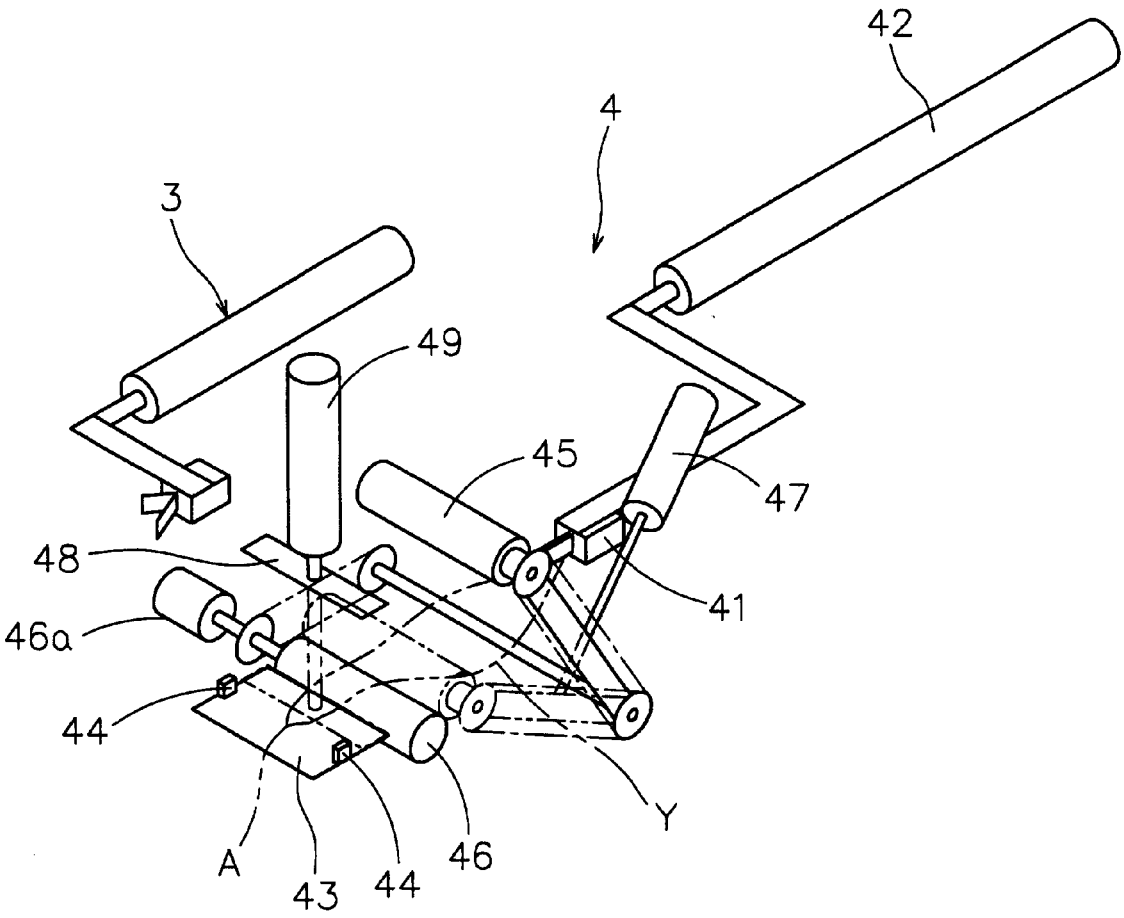
FIG. 4 is a perspective view showing operation of the positioning device of FIG. 3.
Figure 5:
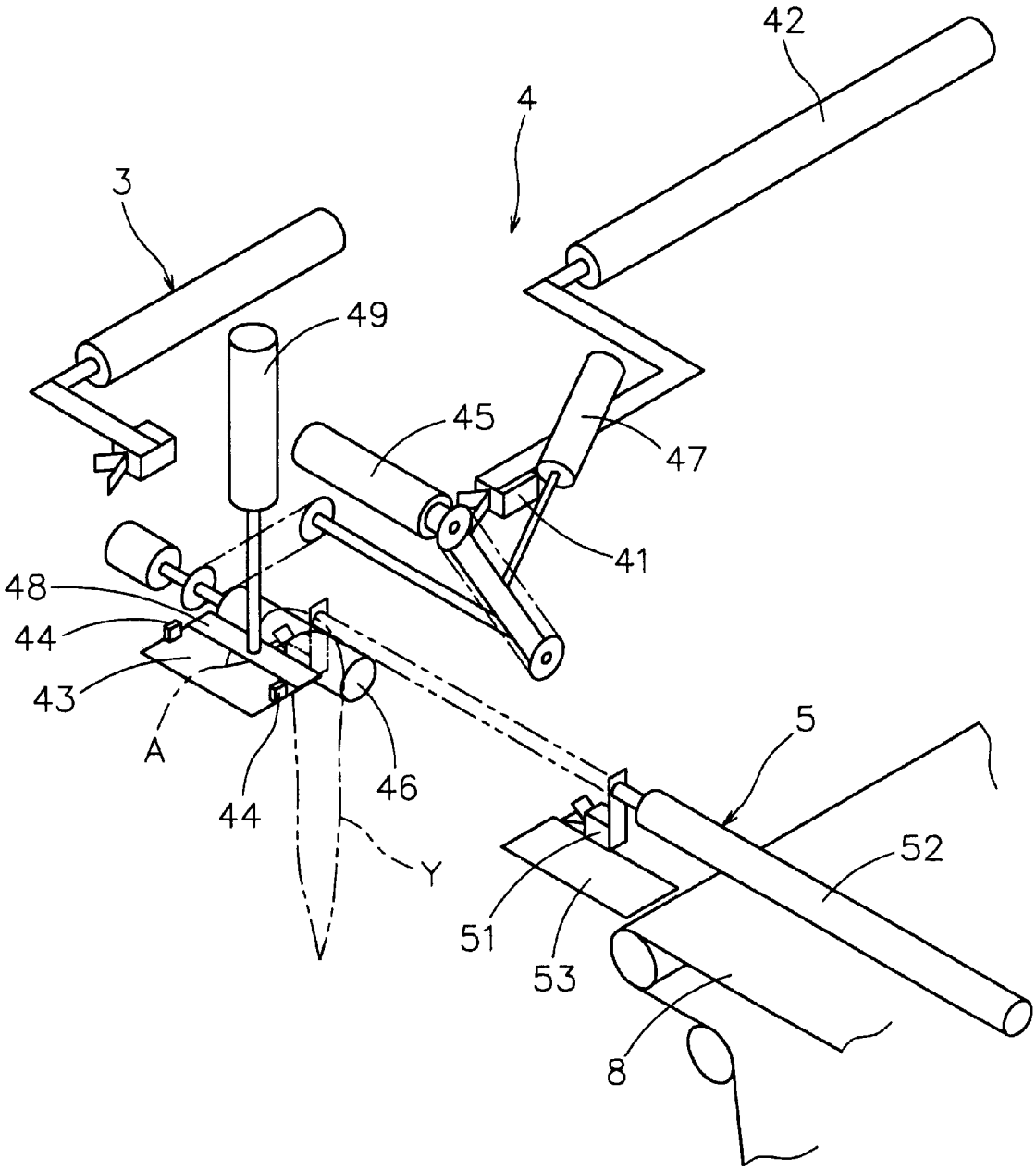
FIG. 5 is a perspective view diagrammaticaly illustrating an extending device of the apparatus of FIG. 1 cooperable with the positioning device of FIG. 3.

As shown in FIG. 3, a positioning device 4 is disposed adjacent to the holding device 3 for positioning the corner portion A of the cloth Y at a predetermined location on a support 43. The positioning device 4 has a chuck 41 for gripping an intermediate portion of the cloth suspended by the chuck 31 in the retracted position and a driving mechanism 42 such as an air cylinder for displacing the chuck 41 between an extended position as shown in FIG. 3 and a retracted position as shown in FIGS. 4 and 5. In the extended position as shown in FIG. 3, the chuck 41 is operable to grip an intermediate portion of the cloth Y suspended from the grip 31 of the holding device 3. After the chuck 41 has gripped the cloth Y, the chuck 31 releases the gripped cloth Y.

The support 43 such as a plate is fixedly disposed just below the path along which the chuck 41 is moved so that, when the chuck 41 gripping the cloth Y is displaced from the extended position to the retracted position, at least a lower part of the suspended cloth Y including the corner portion A is brought into sliding contact with an upper surface of the support 43 and the cloth Y is trailed on the support 43 with the corner portion A being the trailing end.

The positioning device 4 further includes:

- a pair of upper and lower rollers 45 and 46 adapted to form a nip therebetween at a position adjacent to the downstream end of the support 43 as shown by the two-dotted line in FIG. 4,
- an actuating device 47 such as an air cylinder to displace the upper roller 45 between the nip position and a separated position as shown by the solid line in FIG. 4,
- a driving device 46*a* such as a motor to rotate the rollers 45 and 46 for trailing the cloth nipped therebetween,
- a detector 44 such as photoelectric tube for detecting the location of the corner portion A at a predetermined location on the support 43,
- a pressing plate 48 adapted to move between an operating position as shown by the two-dotted line in FIG. 4 where the cloth Y is fixed on the support 43 by being pressed by the plate 48 and a retracted position as shown by the solid line in FIG. 4 where the cloth Y is allowed to be trailed on the support 43, and
- drive means such as an air cylinder 49 to move the pressing plate 48 between the operating position and the retracted position.

When the chuck 41, by which the cloth Y is gripped, has passed above the lower roller 46, the actuating device 47 is energized to displace the upper roller 45 to the nip position as shown by the two-dotted line in FIG. 4, while the chuck 41 release the gripped cloth Y. The motor 46*a* is driven to rotate the rollers 45 and 46 so that the cloth Y nipped therebetween is trailed on the support 43. When the trailing end (corner portion A) is detected by the detector 44, the motor 46*a* is stopped while the air cylinder 49 is actuated to move down the pressing plate 48 and to fix the cloth Y at a position adjacent to the corner portion A. Then, the actuating device 47 is operated to displace the upper roller 45 to the separated position as shown in FIG. 5.

In the above embodiment, the cloth picked up by the chuck 21 of the elevating device 2 is transferred to the chuck 41 of the positioning device 4 through the chuck 31 of the temporary holding device 3. However, the holding device 3 may be omitted. Thus, in another embodiment according to the present invention, the cloth Y gripped by the chuck 21 is directly delivered to the chuck 41.

An end gripper 5 is provided for gripping the corner portion A of the cloth positioned in the predetermined position on the support 43. The gripper 5 has a chuck 51 operatively connected to a driving device 52 such as an air cylinder so that the chuck 51 is displaced between the extended position as shown by the two-dotted line in FIG. 5 and the retracted position as shown by the solid line in FIG. 5. In the extended position, the chuck 51 grips the cloth Y at the corner portion A. In the specific example shown in FIG. 5, the chuck 51 is so arranged as to grip that portion of the cloth Y located in the narrow space between the support 43 and the lower roller 46. The position to be gripped by the chuck 51 is not specifically limited as long as it is the corner portion A or its vicinity.

Figure 6:
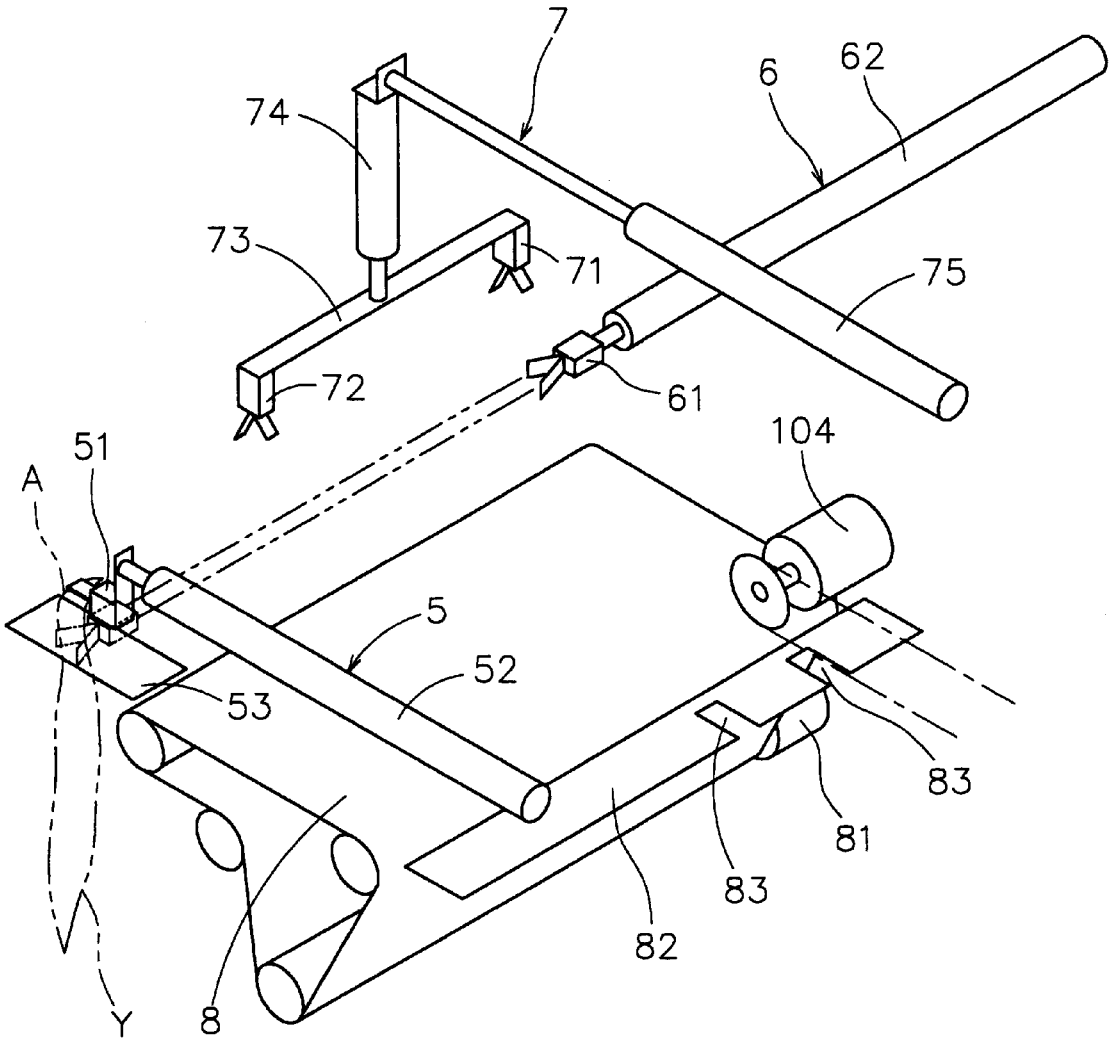
FIG. 6 is a perspective view diagrammatically illustrating supporting means, a pair of grippers, a conveyor and a displacing mechanism of the apparatus of FIG. 1.

When the chuck 51 of the end gripper 5 has gripped the corner portion A, the air cylinder 49 of the positioning device 4 is actuated to displace the pressing plate 48 to the retracted position. The driving device 52 is then operated to retract the chuck 51 to the retracted position as shown in FIG. 6 with the cloth being suspended by the chuck 51 from the corner portion A.

A support device 6 is provided to horizontally supporting the cloth Y. The support device 6 has a support plate 53 disposed adjacent to the retracted position of the chuck 51, a chuck 61 for gripping a portion of the cloth Y adjacent to the corner portion A and a driving device 62 such as an air cylinder for displacing the chuck 61 between an extended position as shown by the two-dotted line in FIG. 6 and a retracted position as shown by the solid line in FIGS. 6 and 7. As shown in FIG. 6, when the chuck 51 gripping the corner portion A is in the retracted position, the chuck 61 extends to the extended position to grip a portion of the cloth adjacent to the gripped corner portion A. Then, the chuck 51 of the end gripper 5 releases the cloth Y so that the cloth Y is suspended by the chuck 61. The driving mechanism 62 is then actuated to move the chuck 61 to the retracted position, so that the cloth Y is generally horizontally extended and supported at least at the corner portion A by the gripper 61 and a portion F2 spaced apart from the corner portion A by the support plate 53.

Figure 7:
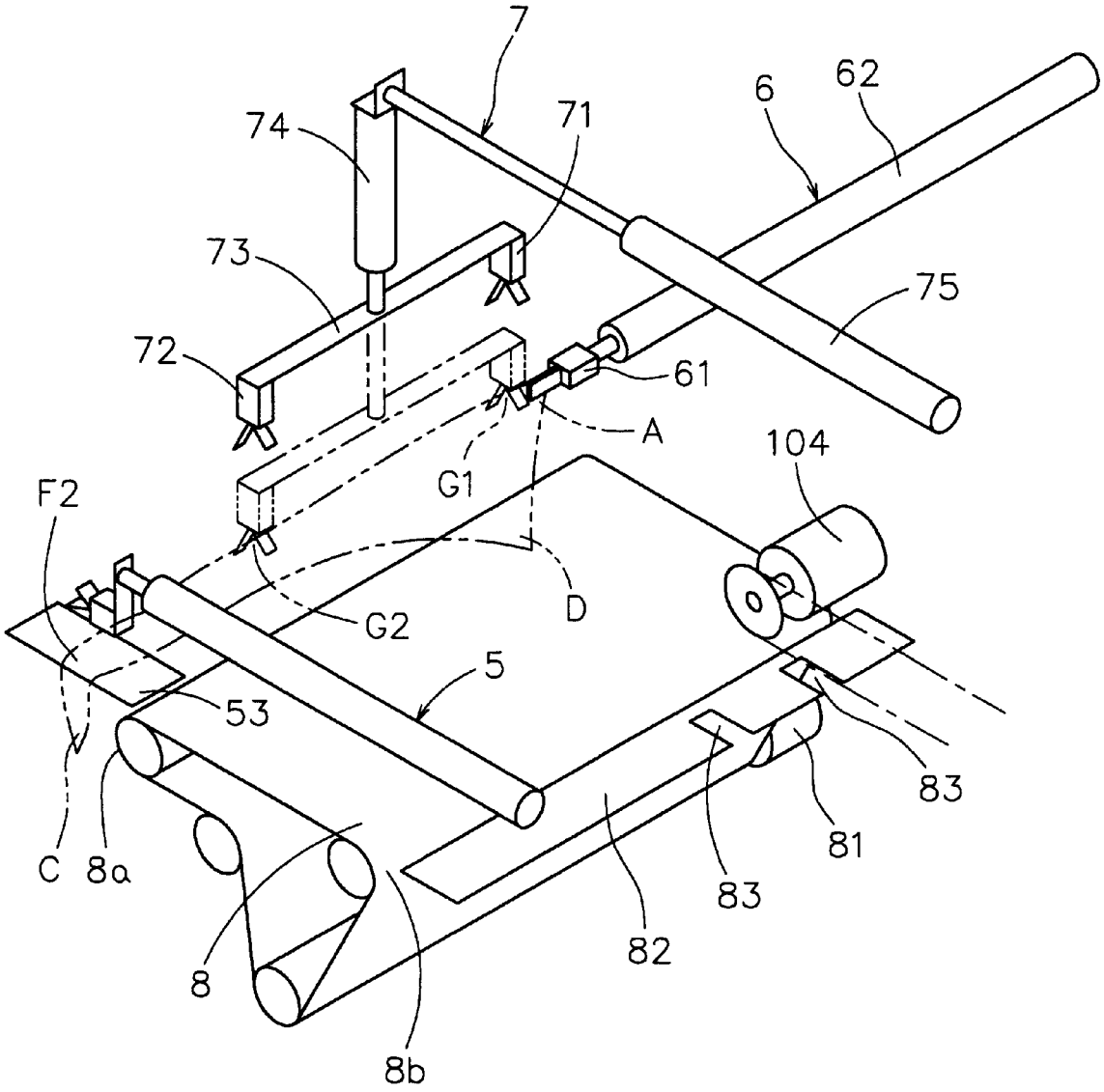
FIG. 7 is a perspective view showing operation of the supporting means and the grippers of FIG. 6.

As shown in FIG. 7, a pair of grippers 71 and 72 are provided for gripping the cloth Y at two, horizontally spaced apart, first and second positions G1 and G2 thereof. The first position G1 is adjacent to the corner portion A while the second position G2 is nearer to the portion F2 than to the first position G1 so that the corner portion D of the cloth Y is suspended therefrom as shown by the two-dotted line in FIG. 7. To expedite the suspension of the corner portion D, air may be preferably blown to the cloth F.

The paired grippers 71 and 72 are secured to a connecting rod 73 connected to an elevating mechanism 74 such as an air cylinder which, in turn, is connected to a displacing mechanism 7 having an air cylinder 75. Thus, by the actuation of the elevating mechanism 74, the paired grippers 71 and 72 are vertically displaced between an upper position as shown by the solid line in FIG. 7 and a lower position as shown by the two-dotted line in FIG. 7. In the lower position, the grippers 71 and 72 can grip the cloth Y at the horizontally spaced apart, first and second positions G1 and G2. Further, by the operation of the displacing mechanism 7, the paired grippers 71 and 72 are horizontally displaced between a first location, as shown in FIG. 7, adjacent to an upstream end 8*a* of a conveyor 8 and a second location, as shown in FIGS. 8 and 9, adjacent to an intermediate portion between the upstream and down stream ends 8*a* and 8*b* of the conveyor 8.

The conveyor 8 is driven by a drive motor 81 and has a flat upper surface running horizontally from the upstream end 8*a* to the downstream end 8*b* in one direction in parallel with the displacing direction of the paired grippers 71 and 72 between the first and second positions.

Figure 8:
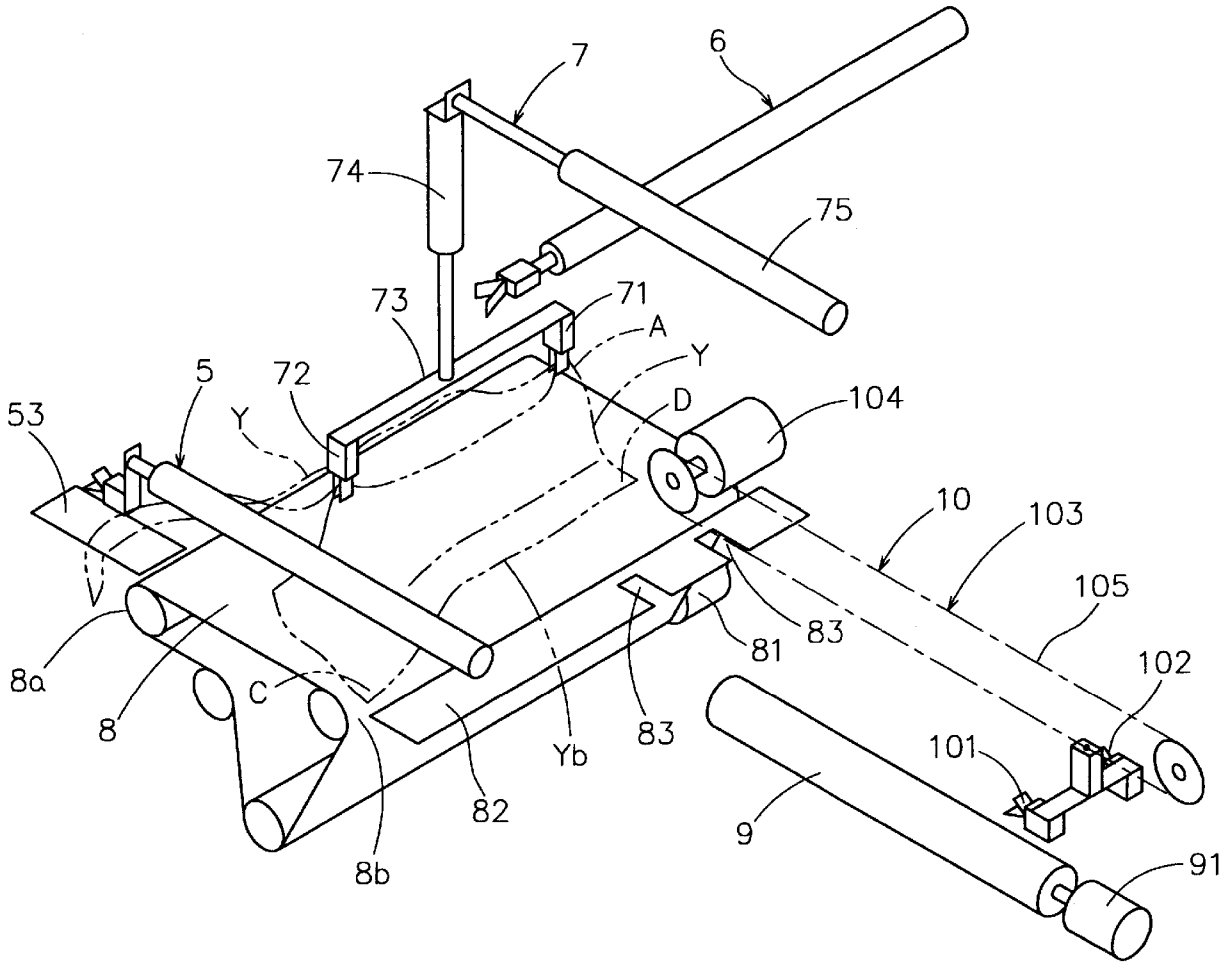
FIG. 8 is a perspective view showing operation of the conveyor and the displacing mechanism of FIG. 6.
Figure 9:
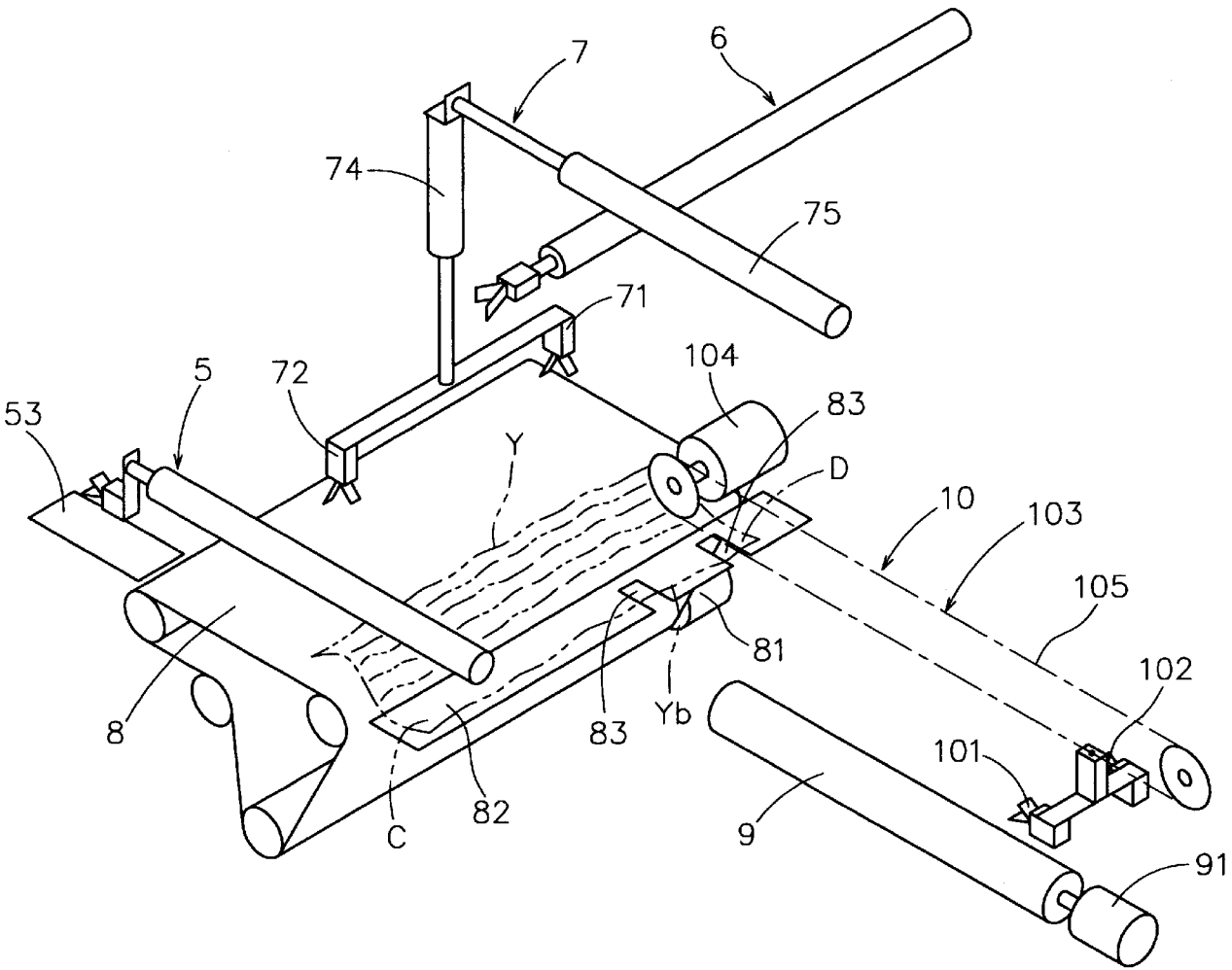
FIG. 9 is a perspective view showing operation of the conveyor of FIG. 6 and also illustrating a horizontal support bar and a positioning mechanism of the apparatus of FIG. 1.

As a consequent of the above construction, when the displacing mechanism 7 is operated to displace the paired grippers 71 and 72, which are positioned in the lower position and which grip the first and second positions G1 and G2, respectively, as shown in FIG. 7, relative to the conveyor 8 from the first location to the second location, while maintaining the line extending through the gripped first and second portions G1 and G2 generally in normal to the running direction of the conveyor 8, the suspended part of the cloth (generally in triangle shape) including the corner portion D is brought into contact with the running conveyor 8 as shown by the broken line in FIG. 8.

When the positioning mechanism 7 being maintained in the retracted state, namely, when the paired grippers 71 and 72 being maintained in the second location, the corner portion D and the other portion of the suspended cloth are successively received on the conveyor and moved thereon toward the downstream end as shown in the two-dotted line in FIG. 8. Thus, a length Yb of the edge CD are straightened being positioned in the downstream end of the conveyor. Then, the paired gripper 71 and 72 release the gripped portions G1 and G2. The cloth is thus moved toward the discharge end 8*b* of the conveyor 8.

A supporting plate 82 is disposed adjacent to the downstream end of the conveyor 8 to receive and support a portion adjacent to the leading, straightened edge Yb of cloth Y. Since the leading straightened edge Yb which has been received on the supporting plate 82 no longer advances, while the trailing portion is continuously moved toward the downstream end 8*b* of the conveyor, wrinkles are formed in the trailing portion as shown in FIG. 9. The supporting plate 82 is provided with a pair of U-shaped recesses 83 in which the straightened edge Yb arriving at the is located. Namely, two, spaced apart, first and second positions H1 and H2 within the range of the straightened edge Yb are positioned in the recesses 83 of the supporting plate 82.

A horizontal support bar 9 is oriented in the direction parallel with the running direction of the conveyor 8 and has one end disposed adjacent to a position between the recesses 83. The support bar 9 in the illustrated embodiment is a roller adapted to rotate through an instructed angle by a drive motor 91.

Figure 10:
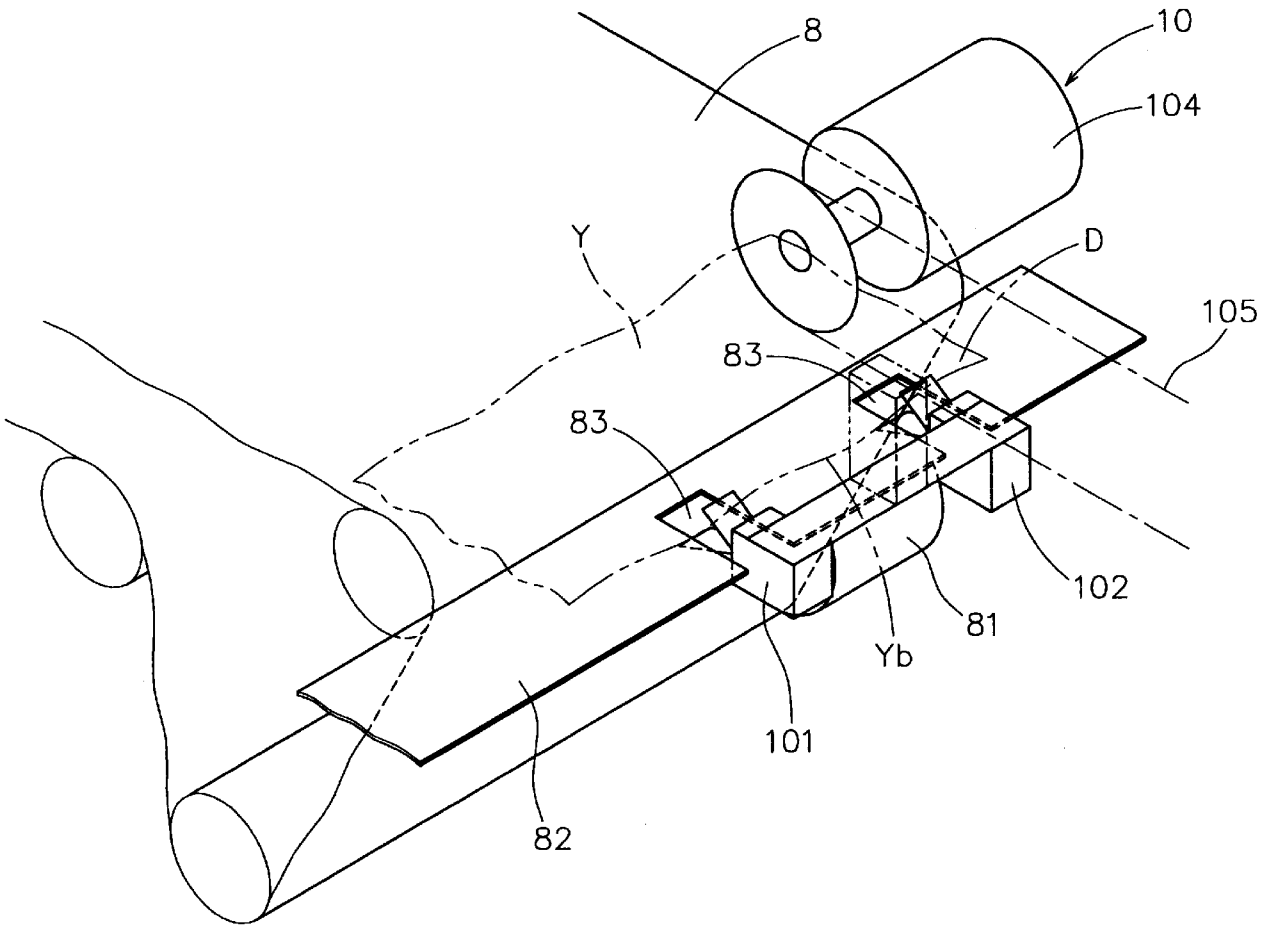
FIG. 10 is an enlarged perspective view of the downstream end of the conveyor of FIG. 6.

A positioning mechanism 10 having a pair of holders 101 and 102 is provided for holding the edge CD of the cloth Y at the first and second positions H1 and H2. The holders 101 and 102 are connected to drive means 103 having a motor 104 and a chain and sprocket mechanism 105. As the driving means 103, an air cylinder may be used if desired. By the operation of the driving means 103, the paired holders 101 and 102 are displaced between a first position, as shown in FIG. 10, where the holders 101 and 102 fit into the recesses 83 of the supporting plate 82 and grasp the first and second positions H1 and H2 of the edge Yb, and a second position, as shown in FIG. 11, where the holders 102 and 103 are located adjacent to adjacent to the other end of the support bar 9.

Figure 11:
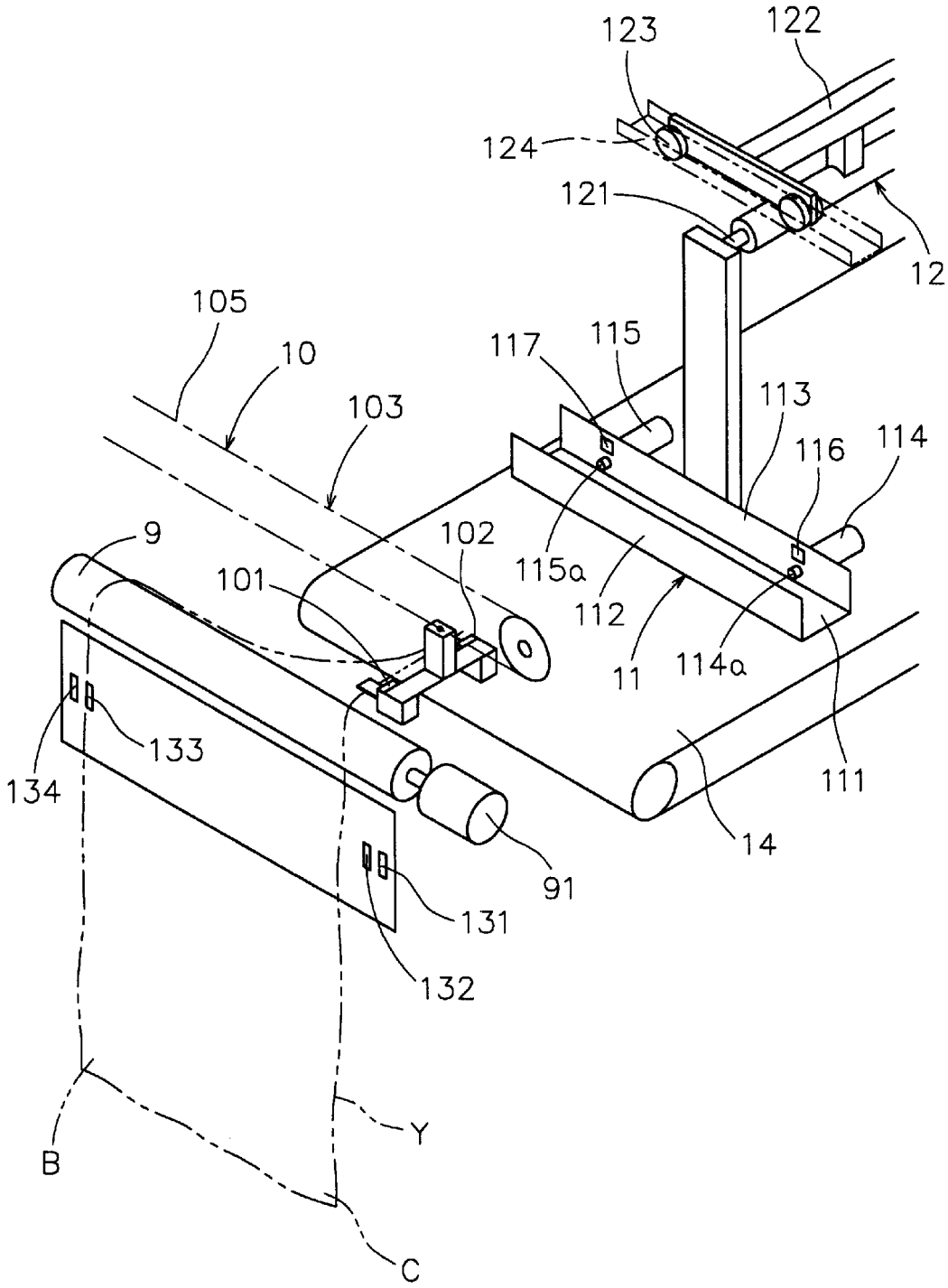
FIG. 11 is a perspective view showing operation of the horizontal support bar and the positioning mechanism of FIG. 9 and also illustrating a fixing device and a delivering mechanism.
Figure 12:
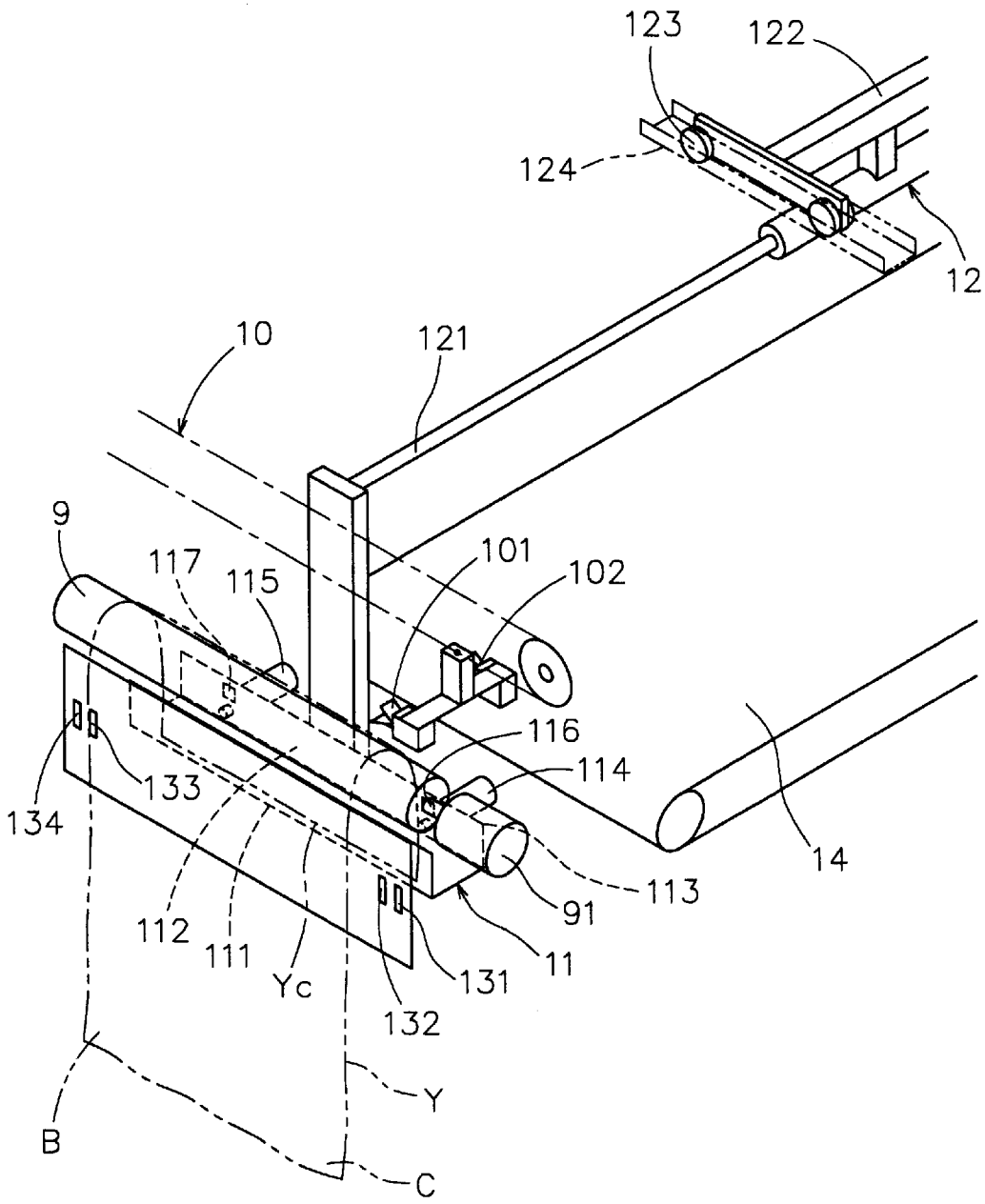
FIG. 12 is a perspective view showing operation of the horizontal support bar, positioning mechanism and fixing device of FIG. 11.

When the paired holders 101 and 102 by which the cloth Y is grasped are displaced from the first position to the second position, the cloth Y is trailed and hung on the support bar 9 with the short edges DA and BC being straightened as shown in FIGS. 11 and 12.

Figure 13:
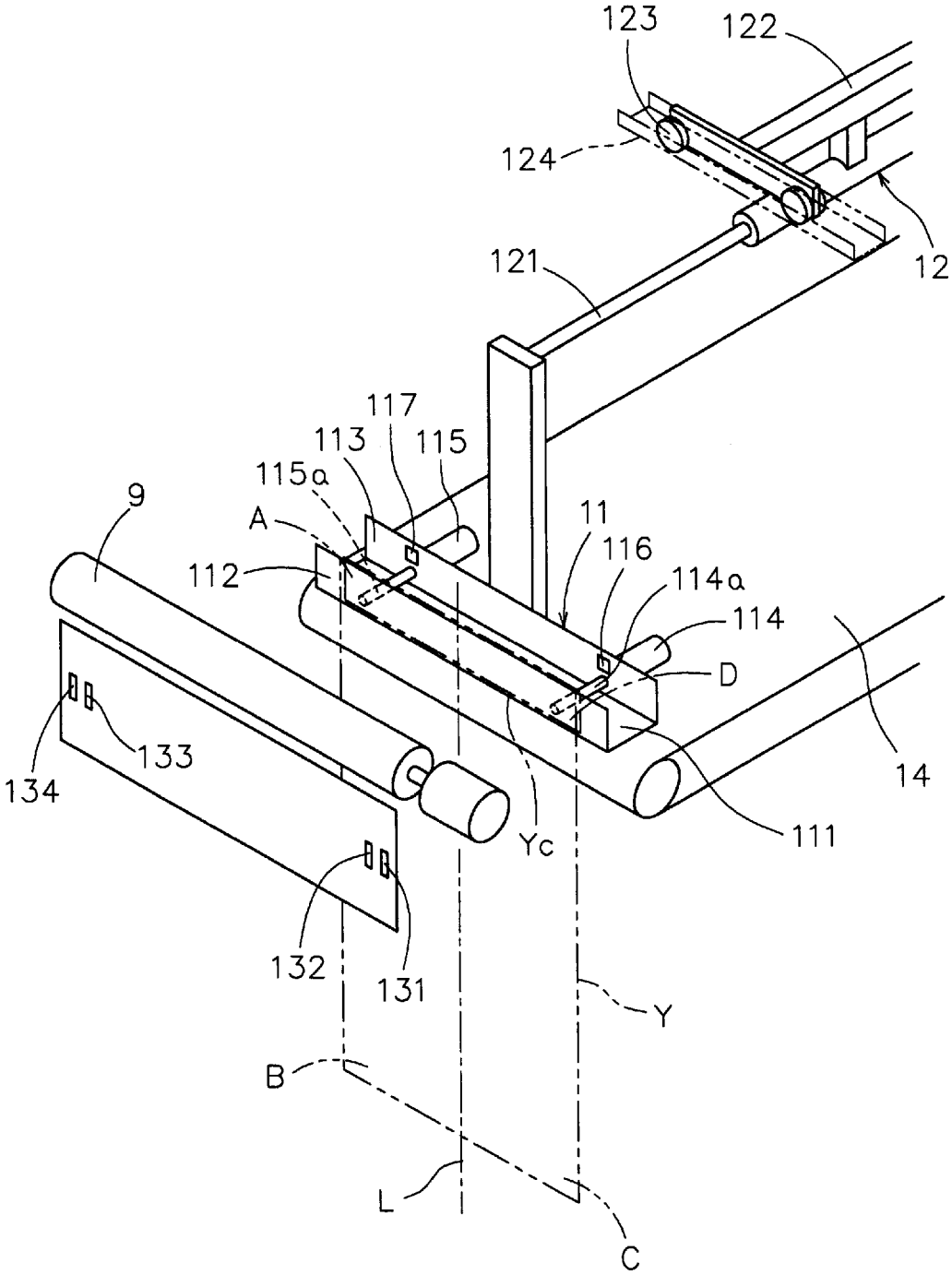
FIG. 13 is a perspective view showing operation of the fixing device of FIG. 11 and also illustrating a position adjusting mechanism of FIG. 1.

A fixing device 11 is provided for holding the straightened short edge DA of the cloth Y and suspending the cloth from the held edge in a spread state. As best seen in FIG. 11, the fixing device 11 includes an elongated U-shaped receiver 111 having opposing vertical front and rear walls 112 and 113, and a pair of chucks 114 and 115 provided on the rear wall 113 and spaced apart from each other a distance slightly smaller than the length of the edge DA. The chucks 114 and 115 in the illustrated embodiment are air cylinders having rods 114*a* and 115*a* each extending through the rear wall 113 and moveable between a retracted position as shown in FIG. 11 and protruded position as shown in FIG. 13. When the rods 114*a* and 115*a* are in the protruded positions and when the edge DA of the cloth Y is located in the U-shaped receiver 111, portions of the cloth adjacent to the corner portions A and D are pressed by the rods 114*a* and 115*a* against the interior surface of the front wall 112, so that the cloth Y is secured therebetween in a spread state. Designated as 116 and 117 are detectors such as photoelectric tubes for detecting the presence of the edge DA of the cloth within the receiver 111. The detectors 116 and 117 are electrically connected with the chucks 114 and 115 so that the chucks 114 and 115 are actuated to fix the cloth Y when the edge DA enters the U-shaped receiver 111.

A displacing device 12 is provided to displace the U-shaped receiver 111 is connected to a receipt position as shown in FIG. 12 and a release position as shown in 11. The displacing device 12 in the illustrated embodiment is an air cylinder having a rod connected to the U-shaped receiver 111 through a stay. In the receipt position, the U-shaped receiver 111 is located just below the roller (supporting bar) 9 to fix the cloth Y by the chucks 115 and 116. In the release position, the chucks 115 and 116 release the cloth Y.

The fixing device 11 operates as follows.

When the holders 101 and 102 grasping the first and second positions H1 and H2 of the edge Yb are displaced to the second position to hang the cloth Y on the support bar 9 with the short edges DA and BC being straightened, the displacing device 12 is operated to displace the U-shaped receiver 111 from the release position as shown in FIG. 11 to the receipt position as shown in FIG. 12. Then, the roller 9 is slowly rotated to lower the edge DA of the cloth into the U-shaped receiver 111, whereupon the detectors 116 and 117 generate detecting signals causing the chucks 114 and 115 to actuate, thereby fixing the cloth Y. The displacing device 12 is then operated to displace the U-shaped receiver 111 from the receipt position toward the release position. When the U-shaped receiver 111 is displaced to an intermediate position, as shown in FIG. 13, between the receipt position and the release position, the rotor 9 rotates at a high speed to drop the cloth Y, so that the cloth Y is suspended in a spread state from the U-shaped receiver 111 as shown by the two-dotted line in FIG. 13.

A delivering mechanism having a delivering conveyor 14 is provided to receive the thus suspended cloth Y and to deliver same to a next station such as for ironing or folding. The conveyor 14 is located beneath and in parallel with the displacing path of the U-shaped receiver 111 and runs in one direction from an upstream end adjacent to the intermediate position of the U-shaped receiver 111 as shown in FIG. 13 to a downstream end adjacent to the next station (not shown).

Figure 14:
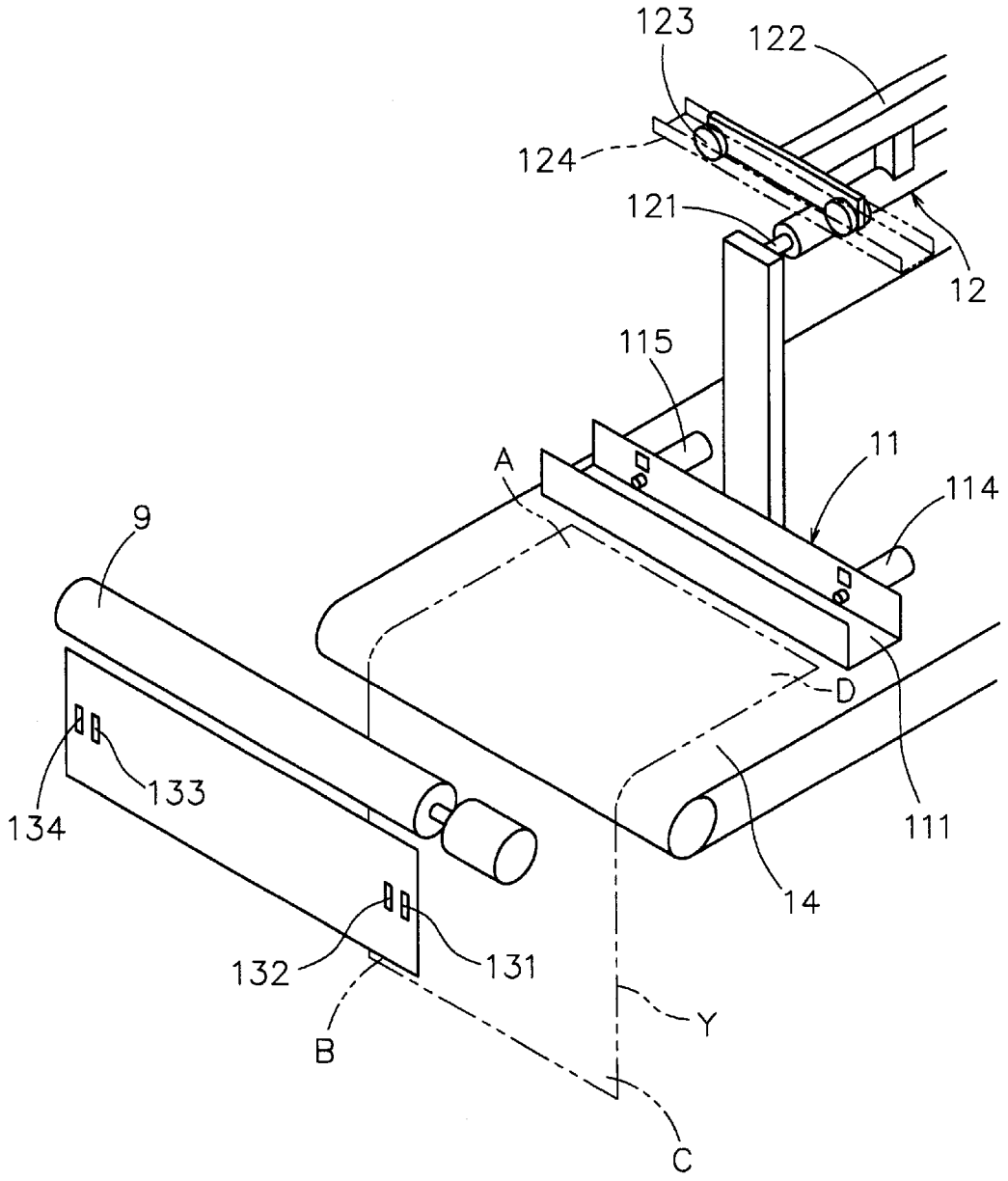
FIGS. 14 and 15 are perspective views showing operation of the delivering mechanism and position adjusting mechanism of FIG. 13.

When the displacing device 12 is operated to displace the U-shaped receiver 111 from the intermediate position toward the release position, the cloth Y suspended from the receiver 111 is moved relative to the delivering conveyor 14 while maintaining the held short edge DA generally in normal to the running direction of the delivering conveyor 14. When the U-shaped receiver 111 is in the release position, the chucks 114 and 115 are operated to release the held cloth Y, so that the cloth is received on said delivering conveyor 14 as shown in FIG. 14 and is moved thereon toward the downstream end thereof as shown in FIG. 15.

For the purpose of receiving the cloth Y on a proper position of the delivering conveyor 14, the fixing device 11 is preferably operatively connected to a position adjusting mechanism 13. The position adjusting mechanism 13 is adapted for moving the fixing device 11 in a direction perpendicular to the running direction of the delivering conveyor 14 so that the cloth Y held by the fixing device 11 is received on the delivering conveyor 14 in a predetermined lateral position relative to the delivering conveyor 14.

In the embodiment illustrated in FIGS. 11–15, the position adjusting mechanism 13 operates so that the chucks 114 and 115 can always hold the cloth Y at predetermined positions (for example, symmetrical) with respect to the center line L of the width of the cloth Y (FIG. 13). The position adjusting mechanism 13 includes four detectors 131–134 such as photoelectric tubes for detecting edges AB and CD of the cloth Y hanging on the roller 9. The distance of the inside detectors 132 and 133 is slightly greater (for example by 10–20 mm) than the width (namely, edges BC and DA) of the cloth Y, while the outside detectors 131 and 134 are located such that the distance between the detectors 131 and 132 is equal to the distance between the detectors 133 and 134 and is for example 10–20 mm.

The position adjusting mechanism 13 also includes displacing means 135 responsive to the detection signals from the detectors 131–134 for displacing the fixing device 11 in the direction perpendicular to the displacing direction of the U-shaped receiver 111, namely in parallel with the rotor 9. As shown in FIG. 15, the displacing device 12 is fixedly secured to a beam 122 extending in parallel with the displacing direction of the U-shaped receiver 111 and having opposing ends each provided with front and rear wheels 123. The wheels 123 are supported on parallel rails 124 extending in the direction perpendicular to the beam 122. Two air cylinders 136 and 137 constituting the displacing means 135 are connected to the beam 122 and operable to extend their rods in opposite directions. Each of the cylinders 136 and 137 can assume a retracted position, an extended position and a further extended position, so that the U-shaped receiver 111 is moveable from the basal position to one of the right, further right, left and further left positions, as seen from the running direction of the conveyor 14, depending upon the extension states of the cylinders 136 and 137.

When the cloth Y hung on the rotor 9 is located between the detectors 132 and 133, the cylinders 136 and 137 are not actuated so that the U-shaped receiver 111 in the receipt position assume the basal position and, after the edge DA has been displaced in the U-shaped receiver 111 by rotation of the rotor 9, the chucks 116 and 117 holds the cloth Y at the predetermined positions relative to the centerline L of the cloth Y. When the cloth Y hung on the rotor is located offset from the basal position, for example at such a position that the two detectors 131 and 132 detect the presence of the cloth Y, the cylinders 136 and 137 are operated so that the U-shaped receiver 111 in the receipt position assumes the further right position. Then, the rotor 9 is rotated to displace the edge DA in the U-shaped receiver 111 and the chucks 116 and 117 holds the cloth Y at the predetermined positions relative to the centerline L of the cloth Y. After the U-shaped receiver 111 is displaced to the intermediate position as shown in FIG. 3, the cylinders 136 and 137 are operated to laterally displace the U-shaped receiver 111 to the original basal position. The cloth Y is then received on the conveyor 14 with the centerline L of the cloth Y coinciding with the reference line (for example, centerline) of the conveyor 14.

In the above embodiment, a combination of a chain and sprocket mechanism with a drive motor may be used as the displacing means 135. Further, the detectors may be disposed to detect the edges of the cloth Y suspended from the U-shaped receiver 111 as shown in FIG. 13 so as to adjust the position of the suspended cloth Y held by U-shaped receiver 111 relative to the delivering conveyor 14.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2000-308662, filed Oct. 10, 2000, inclusive of the specification, claims and drawings, are hereby incorporated by reference herein.

What is claimed is:

1. A method for spreading a laundered generally rectangular cloth having four corner portions (A–D), opposing longer edges (AB and CD) and opposing shorter edges (BC and DA), comprising the steps of:

(a) picking up a portion (F1) of the cloth and elevating the picked portion so that the cloth is suspended from the picked portion with one corner portion (A) being the lowermost end of the cloth;

(b) trailing the cloth on a support to position the corner portion (A), being the trailing end of the cloth, at a predetermined location on said support;

(c) gripping the corner portion (A) positioned at said predetermined location;

(d) supporting the cloth horizontally at least at the gripped corner portion (A) and a portion (F2) spaced apart from the corner portion (A);

(e) regripping the cloth at two, horizontally spaced apart, first and second positions (G1 and G2) thereof, said first position (G1) being adjacent to the corner portion (A) and said second position (G2) being nearer to the position (F2) than to said first position (G1) so that the corner portion (D) is suspended therefrom;

(f) displacing the gripped first and second positions (G1 and G2) relative to a conveyor running in one direction from an upstream end to a downstream end while maintaining the line extending through the gripped first and second portions (G1 and G2) generally in normal to the running direction of the conveyor, so that the corner portion (D) and the other portion of the cloth are successively received on the conveyor and moved thereon toward the downstream end with a length of the edge CD being positioned in the downstream end of the conveyor;

(g) grasping the edge CD of the cloth at two, spaced apart, first and second positions (H1 and H2) thereof located within the range of said length;

(h) displacing the grasped first and second positions (H1 and H2) toward a horizontal support bar extending in a direction parallel to the displacing direction of the grasped first and second positions (H1 and H2) to hang the cloth thereon with the short edges (DA and BC) being straightened; and (i) holding one of the straightened short edges (DA and BC) and suspending the cloth from said held edge in a spread state.

2. A method as claimed in claim 1, wherein, after the corner portion (A) has been positioned at the predetermined location, a portion adjacent to the corner portion (A) is temporarily fixed on said support, and wherein the corner portion (A) is gripped while said portion adjacent to the corner portion (A) is fixed on said support.

3. A method as claimed in claim 1, wherein said portion (F2) is nearer to the corner portion (C) than to the gripped corner portion (A).

4. A method as claimed in claim 1, wherein said second position (G2) is spaced apart at a predetermined distance from said first position (G1) which distance is greater than the length of the short edge (DA).

5. A method as claimed in claim 1, further comprising displacing the held, straightened short edge relative to a delivering conveyor running in one direction from an upstream end to a downstream end while maintaining the held short edge generally in normal to the running direction of the delivering conveyor, so that the held cloth is received on the delivering conveyor and moved thereon toward the downstream end.

6. A method as claimed in claim 5, further comprising, before the cloth is received on the delivering conveyor, moving the held, straightened short edge in a direction perpendicular to the running direction of the delivering conveyor so that the cloth is received on the delivering conveyor in a predetermined lateral position relative to the delivering conveyor.

7. An apparatus for spreading a laundered rectangular cloth placed in a predetermined position and having four corner portions (A–D), opposing longer edges (AB and CD) and opposing shorter edges (BC and DA), comprising:

an elevating device adapted for picking up a portion (F1) of the cloth placed at the predetermined position and elevating the picked portion at a predetermined height so that the cloth is suspended from the picked portion with one corner portion (A) being the lowermost end of the cloth;

a support having an upper surface adapted to support of at least a part of the cloth thereon;

a positioning device for receiving the suspended cloth and trailing the cloth on a support to position the corner portion (A), being the trailing end of the cloth, at a predetermined location on said support;

an end gripper for gripping the corner portion (A) of the cloth positioned in said predetermined height;

supporting means for horizontally supporting the cloth at least at the corner portion (A) and a portion (F2) spaced apart from the corner portion (A);

a pair of grippers for gripping the cloth at two, horizontally spaced apart, first and second positions (G1 and G2) thereof, said first position (G1) being adjacent to the corner portion (A) and said second position (G2) being nearer to the portion (F2) than to the first position (G1) so that the corner portion (D) is suspended therefrom;

a conveyor running in one direction from an upstream end to a downstream end;

a displacing mechanism for displacing said grippers such that the gripped first and second positions (G1 and G2) are displaced relative to said conveyor while maintaining the line extending through the gripped first and second portions (G1 and G2) generally in normal to the running direction of said conveyor, so that the corner portion (D) and the other portion of the cloth are successively received on the conveyor and moved thereon toward the downstream end with a length of the edge CD being positioned in the downstream end of the conveyor;

a horizontal support bar;

a positioning mechanism having a pair of holders for holding the edge CD of the cloth at two, spaced apart, first and second positions (H1 and H2) thereof located within the range of said length and having displacing means for displacing said holders in a direction parallel to said horizontal support bar in position for hanging the cloth thereon with the short edges (DA and BC) being straightened; and a fixing device for holding one of the straightened short edges (DA and BC) and suspending the cloth from the held edge in a spread state.

8. An apparatus as claimed in claim 7, further comprising a delivering mechanism having a delivering conveyor running in one direction from an upstream end to a downstream end, and displacing means for displacing said fixing device relative to said delivering conveyor in a direction parallel with the running direction of said delivering conveyor, so that, upon displacement of said fixing device, the cloth held by the fixing device is received on said delivering conveyor and moved thereon toward the downstream end thereof.

9. An apparatus as claimed in claim 8, further comprising a position adjusting mechanism for moving said fixing device in a direction perpendicular to the running direction of said delivering conveyor so that the cloth is received on said delivering conveyor in a predetermined lateral position relative to said delivering conveyor.

* * * * *

UNITED STATES PATENT AND TRADEMARK OFFICE

CERTIFICATE OF CORRECTION

PATENT NO. : 6,477,797 B1
DATED : November 12, 2002
INVENTOR(S) : Takahashi et al.

It is certified that error appears in the above-identified patent and that said Letters Patent is hereby corrected as shown below:

Column 1,
Line 66, “eing” should read -- being --.

Column 2,
Line 1, “part” should read -- apart --; and
Line 12, begin a new paragraph with “In”.

Figure 1:
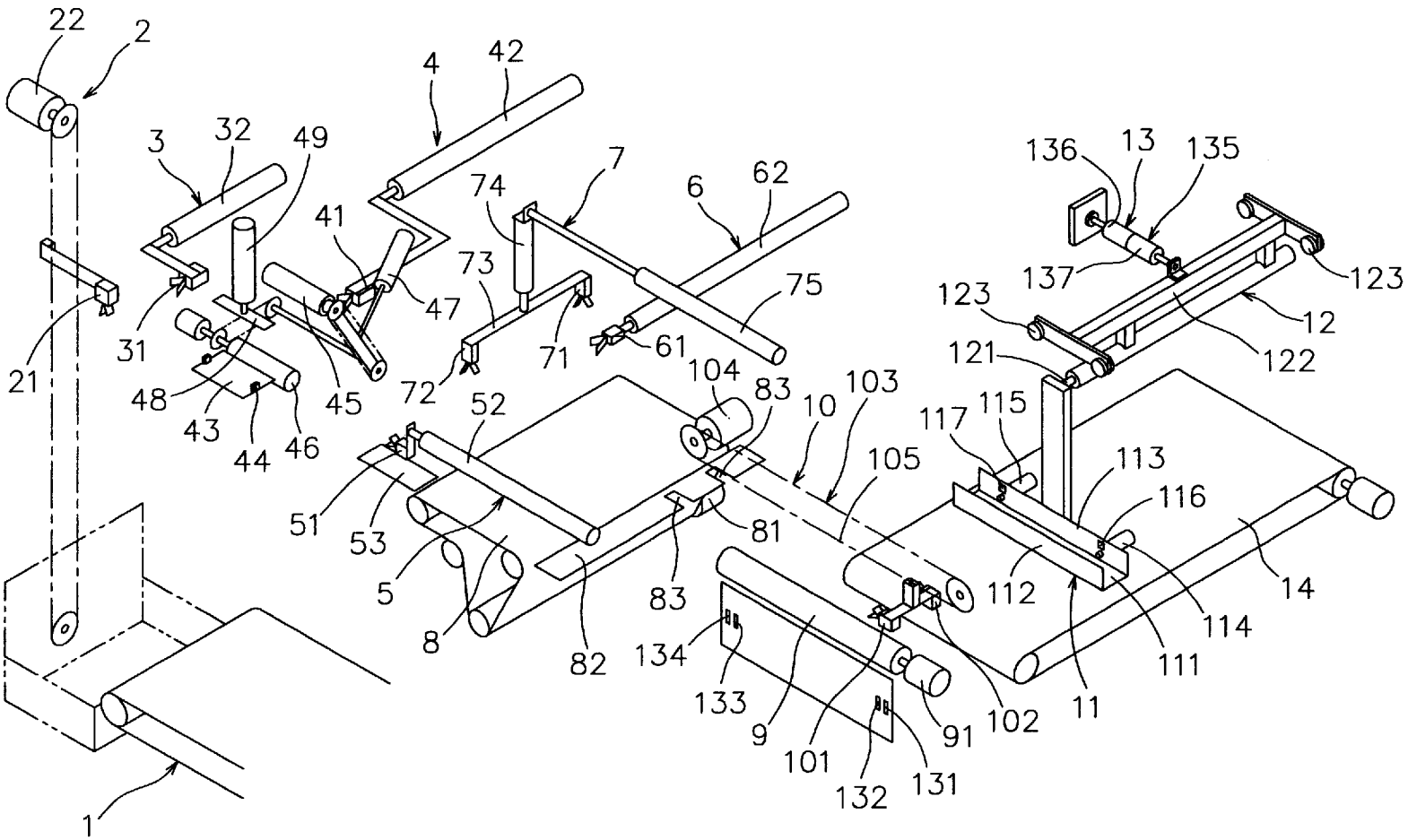
FIG. 1 is a perspective view schematically illustrating an embodiment of a spreading apparatus suitable for carrying out a method of the present invention.

Column 3,
Line 10, “FIG” should read -- FIG. 1; --.

Signed and Sealed this

Fifteenth Day of April, 2003

JAMES E. ROGAN
*Director of the United States Patent and Trademark Office*